US012516508B2

(12) United States Patent
Nakamoto et al.

(10) Patent No.: US 12,516,508 B2
(45) Date of Patent: Jan. 6, 2026

(54) SYSTEM, METHOD, AND NON-TRANSITORY COMPUTER-READABLE STORAGE MEDIUM FOR WORK MACHINE GUIDANCE

(71) Applicant: Caterpillar SARL, Geneva (CH)

(72) Inventors: Youzou Nakamoto, Hyogo (JP); Naoki Sumigaki, Hyogo (JP)

(73) Assignee: Caterpillar SARL, Geneva (CH)

( * ) Notice: Subject to any disclaimer, the term of this patent is extended or adjusted under 35 U.S.C. 154(b) by 195 days.

(21) Appl. No.: 18/240,359

(22) Filed: Aug. 31, 2023

(65) Prior Publication Data

US 2025/0075471 A1 Mar. 6, 2025

(51) Int. Cl.

| | |
|---|---|
| ***E02F 9/26*** | (2006.01) |
| ***E02D 3/026*** | (2006.01) |
| ***E02D 3/074*** | (2006.01) |
| ***E02F 3/96*** | (2006.01) |
| ***E02F 9/20*** | (2006.01) |

(52) U.S. Cl.

CPC ..... *E02F 9/265* (2013.01); *E02D 3/026* (2013.01); *E02D 3/074* (2013.01); *E02F 3/963* (2013.01); *E02F 3/966* (2013.01); *E02F 3/967* (2013.01); *E02F 9/205* (2013.01); *E02F 9/262* (2013.01)

(58) Field of Classification Search

CPC . E02F 9/265; E02F 3/963; E02F 3/966; E02F 3/967; E02F 9/205; E02F 9/262; E02D 3/026; E02D 3/074

See application file for complete search history.

(56) References Cited

U.S. PATENT DOCUMENTS

| | | | | |
|---|---|---|---|---|
| 5,244,306 | A * | 9/1993 | Artzberger | E02F 3/967 404/128 |
| 5,526,590 | A | 6/1996 | Palm et al. | |
| 6,158,949 | A * | 12/2000 | Walth | E02F 3/38 414/722 |
| 7,630,793 | B2 * | 12/2009 | Thomas | E02F 9/26 701/50 |
| 8,393,825 | B2 * | 3/2013 | Marsolek | E01C 19/286 404/117 |
| 9,510,522 | B2 * | 12/2016 | Yrjänä | B66C 23/42 |
| 11,814,816 | B2 * | 11/2023 | Kean | E02F 9/262 |
| 2010/0185335 | A1 | 7/2010 | Sawada | |

FOREIGN PATENT DOCUMENTS

| | | | |
|---|---|---|---|
| DE | 112009000259 | T5 | 5/2011 |
| DE | 112022004302 | T5 | 8/2024 |
| EP | 3812517 | A1 | 4/2021 |

(Continued)

OTHER PUBLICATIONS

Examination Report for German Patent Appln. No. 102024124347.3, mailed Jul. 15, 2025 (8 pgs).

*Primary Examiner* — Gertrude Arthur Jeanglaude

(57) ABSTRACT

A work machine can comprise a work tool attached to an end of a boom of the work machine, and processing circuitry. The processing circuitry can be configured to determine a type of the work tool; set a focus point of the work tool based on the type of the work tool; measure a posture of the work tool based on the focus point; and provide a guidance function to an operator of the work machine in accordance with the measured posture of the work tool based on the focus point.

20 Claims, 13 Drawing Sheets

(56) References Cited

FOREIGN PATENT DOCUMENTS

| | | | |
|---|---|---|---|
| JP | H05-34443 | B2 | 5/1993 |
| JP | H07207712 | A | 8/1995 |
| JP | H08-135204 | A | 5/1996 |
| JP | H09-111798 | A | 4/1997 |
| JP | H09-302610 | A | 11/1997 |
| JP | 2008-266975 | A | 11/2008 |

* cited by examiner

SYSTEM, METHOD, AND NON-TRANSITORY COMPUTER-READABLE STORAGE MEDIUM FOR WORK MACHINE GUIDANCE

TECHNICAL FIELD

The present disclosure relates to work machines, and more particularly to construction machines having various work tools, and systems, assemblies, and methods thereof.

BACKGROUND

Work machines, particularly those in construction, mining, earth moving, goods handling, forestry, agriculture, or other such industries, typically utilize a tool controlled by an operator to perform work. A variety of work tools may be attached to an arm arrangement of a multipurpose machine (e.g., excavators) via a coupling arrangement for performing different types of work.

Japanese Publication of Patent Application JPH07-207712 ("the JP '712 Publication") describes a work machine to set monitor points on a front work equipment including a boom, an arm and a bucket to limit the working range upward/downward. According to the JP '712 Publication, the bucket can be controlled by controlling speed of actuators of the front work equipment for avoiding the collision of the front work equipment and an obstacle.

In addition to the function for avoiding the collision, it has been desired to enable guidance functions for work machines which mount various work tools to assist an operator of the work machines.

SUMMARY

According to an aspect a work machine is described or provided. The work machine can comprise a work tool attached to an end of a boom of the work machine, and processing circuitry. The processing circuitry can be configured to determine a type of the work tool, set a focus point of the work tool based on the type of the work tool, measure a posture of the work tool based on the focus point, and provide a guidance function to an operator of the work machine in accordance with the measured posture of the work tool based on the focus point.

In another aspect, a method for a work machine is disclosed or implemented. The method can comprise determining a type of a work tool of the work machine, outputting selectable information via an operator interface to select a focus point of the work tool from one or more candidates in accordance with the determined type of the work tool, setting the focus point of the work tool based on input via the operator interface, measuring a posture of the work tool based on the focus point, outputting guidance information based on the measured posture of the work tool and the focus point of the work tool, and providing a guidance function to the operator interface in accordance with the measured posture of the work tool based on the focus point.

And in another aspect a non-transitory computer-readable storage medium is disclosed or provided. The non-transitory computer-readable storage medium can comprise computer executable instructions, wherein the instructions, when executed by an information processing system of a work machine, cause the information processing system to perform a method, the method comprising, determining a type of a work tool of the work machine, setting a focus point of the work tool based on input via an operator interface, measuring a posture of the work tool based on the focus point, determining a type of output information based on the type of the work tool, the output information including direction information of the work tool, providing a guidance function with a first type of output information to the operator interface in accordance with the measured posture of the work tool based on the focus point, switching the type of output information from the first type of output information to a second type of output information under a condition that the work tool is replaced from a first type of the work tool to a second type of the work tool, and providing the guidance function with the second type of output information to the operator interface in accordance with the measured posture of the work tool based on the focus point.

Other features and aspects of this disclosure will be apparent from the following description and the accompanying drawings.

DETAILED DESCRIPTION

The present disclosure relates to work machines, and more particularly to construction machines having various work tools, and systems, assemblies, and methods thereof. Generally, embodiments of the disclosed subject matter can implement the work machine that can determine an appropriate focus point based on types of work tools and operate guidance functions based on the focus point.

Figure 1:
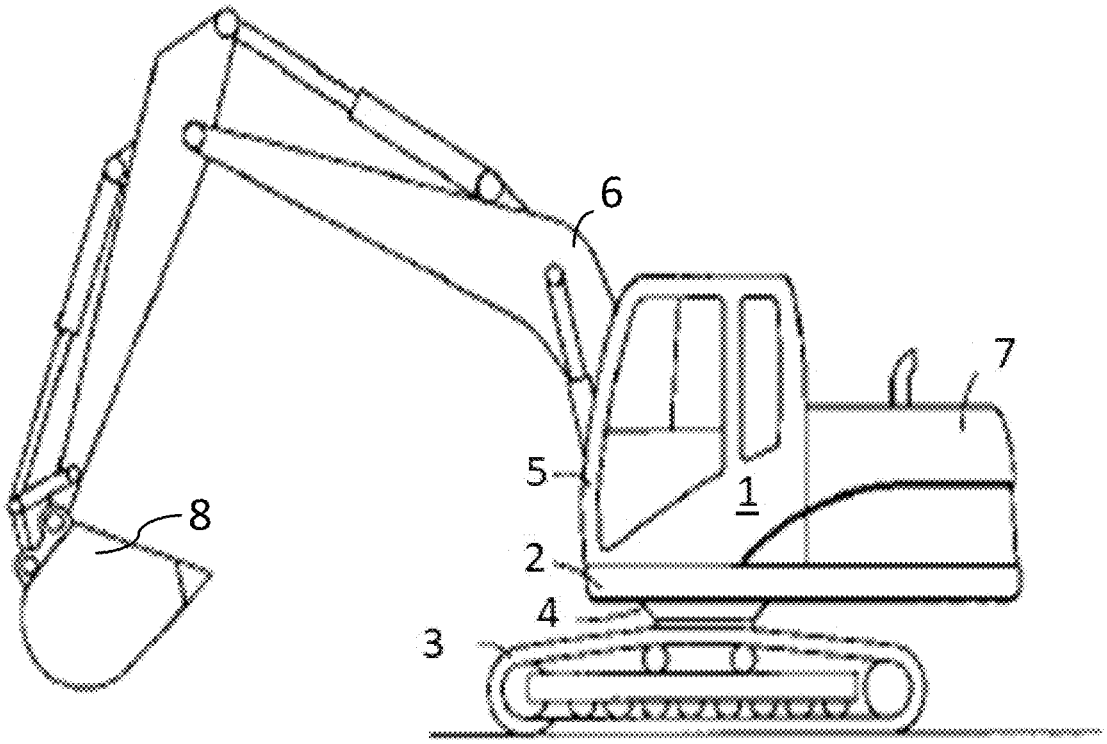
FIG. 1 is a side view of an excavator as an example of a work machine according to one or more embodiments of the disclosed subject matter.

Turning to the figures, FIG. 1 shows an excavator (e.g., hydraulic) as a work machine 1, according to one or more embodiments of the disclosed subject matter, though embodiments of the disclosed subject matter are not so limited. The work machine 1 in the form of an excavator may be referred to as a crawler.

Regarding the work machine 1, an upper swing body 2 can be rotatably provided as a machine body on a lower traveling body 3, via a swing bearing portion 4. The lower traveling body 3 can have left and right tracks controllable (via respective hydraulic motors) to cause the work machine 1 to travel in a travel direction (forward or reverse). A cab 5 can be mounted on one side of a front part of the upper swing body 2, and a driver's seat, one or more operation levers, and the like can be installed in the cab 5. Furthermore, a boom 6 for excavation work can be mounted on the other side of the front part of the upper swing body 2. An engine and a power device such as a hydraulic pump which is driven by the engine can be mounted on the rear part of the upper swing body 2 and covered with a power device cover 7.

The boom 6 can be pivotally attached to a stick that may be terminated with a work tool 8 such as a bucket. The work tool 8 may be attached to the arm of the work machine 1 via a coupling arrangement for performing various types of work. It is noted that embodiments of the disclosed subject matter are not limited to a bucket as the work tool 8 as shown in FIG. 1. For instance, embodiments of the disclosed subject matter can include any other suitable accessories or tools than a bucket, such as a hammer, vibratory compactor, compaction wheel, fork, plow, handling arm, multi-processor, pulveriser, saw, shears, blower, grinder, tiller, trencher, winch, auger, blade, broom, cutter, planer, delimber, felling head, grapple, mulcher, ripper, or the like.

Figure 2A:
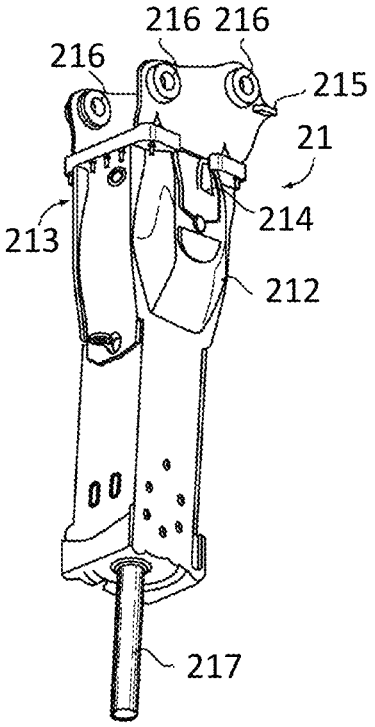
FIGS. 2A, 2B and 2C are perspective views of a work tool of a work machine according to one or more embodiments of the disclosed subject matter.
Figure 2B:
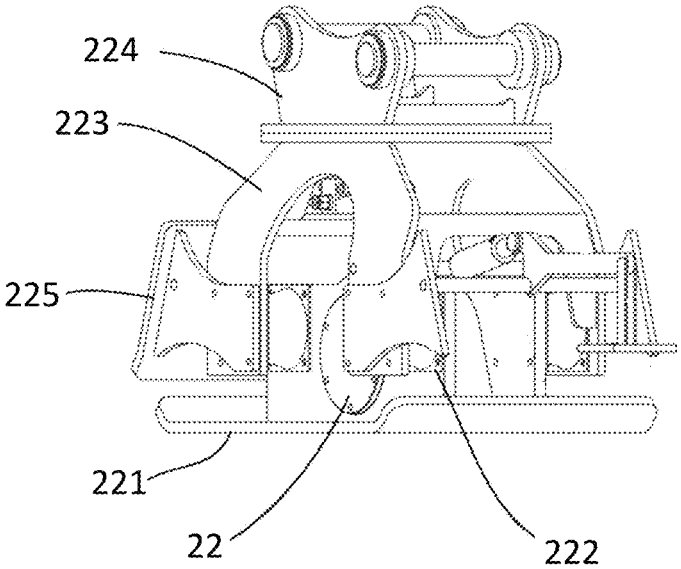
Figure 2C:
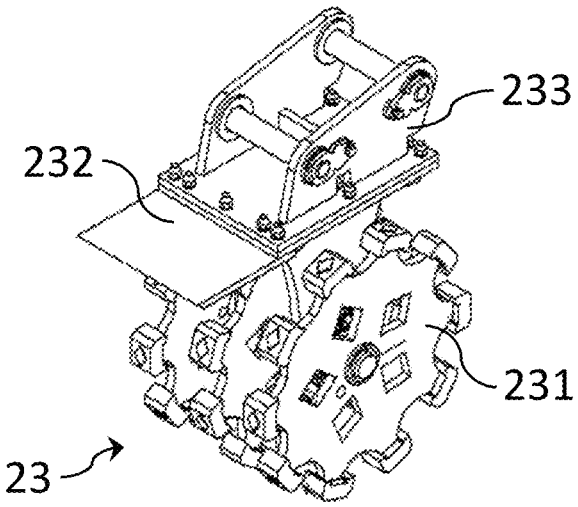

Turning now to FIGS. 2A, 2B and 2C, FIGS. 2A to 2C are perspective views of the work tool 8 according to one or more embodiments of the disclosed subject matter. As illustrated in FIG. 2A, a hammer 21 can be provided as the work tool 8 of the work machine 1. The work machine 1 can crush rocks and structures with impact force of a chisel 217 of the hammer 21 when the hammer 21 is attached to the work machine 1 as the work tool 8. Referring now to FIG. 2A, the hammer 21 may include a powercell housing 212 defining a hydraulic inlet 213 and a hydraulic outlet 214 that may be connected to a hydraulic implement system of the work machine 1. A machine mount 215 can be attached to one end of the powercell housing 212 and can include a plurality of pin receiving bores 216 that may be distributed in a pattern to match the boom attachment features of the work machine 1. The chisel 217 can be partially received in, and movable with respect to, the powercell housing 212.

Also, as illustrated in FIG. 2B, a vibratory compactor 22 can be provided as the work tool 8 of the work machine 1. The vibratory compactor 22 may include a base plate 221, a vibration mechanism 222, a support frame 223, a bracket 224, and a blade 225.

The vibration mechanism 222 may comprise a hydraulic motor and an eccentric mechanism driven by the hydraulic motor, the hydraulic motor is connected with a power system of the work machine 1, and the hydraulic motor drives the eccentric mechanism to rotate to generate eccentric force through rotation, so that the soil is compacted by the base plate 221 that is vibrated in the vertical direction.

The support frame 223 may be provided as a pair of side plates on both sides of the underside of the bracket 224. The bracket 224 can include a plurality of pin receiving bores that may be distributed in a pattern to match the boom attachment features of the work machine 1.

In this embodiment, the blade 225 may be provided at a rear side of the body of the vibratory compactor 22 for bulldozing or shoveling a material (e.g., (e.g., soil, dirt, rocks, sand, bricks, and/or other materials). The blade 225 can be moved along the ground by raising and lowering the boom 6 of the work machine 1. Optionally or alternatively, the blade 225 can be mounted to a front side of the vibratory compactor 22.

Also, as illustrated in FIG. 2C, a wheel compactor 23 can be provided as the work tool 8 of the work machine 1. The wheel compactor 23 may include a roller 231, a blade 232 and a bracket 233.

The roller 231 can be used for breaking up hard soil by rotating. The blade 232 can be used in collaboration with the roller 231, to create smooth trench bottom. The blade 232 can be mounted on either side of the roller 231, depending on how the operator of the work machine 1 prefers to push/pull material into the trench.

The bracket 233 can include a plurality of pin receiving bores that may be distributed in a pattern to match the boom attachment features of the work machine 1.

In this embodiment, the work machine 1 may provide various guidance functions to assist the operator's operation, such as "Machine Guidance Function" (hereinafter, it may be referred as a first guidance function) and "E-Fence Function" (hereinafter, it may be referred as a second guidance function). More specifically, if the operator of the work machine 1 activates the Machine Guidance Function, the work machine 1 may provide notification of state information of the work machine 1 to the operator so that the operator can control the machine based on the state information, in case that the work tool 8 is any one of the bucket, the hammer 21, the vibratory compactor 22, and the wheel compactor 23. Similarly, if the operator of the work machine 1 activates the E-Fence Function, the work machine 1 may control to limit work area (i.e., height/depth/distance) of the work tool 8 and control actuators for avoiding interference between the work tool 8 and the cab 5, in case that the work tool 8 is any one of the bucket, the hammer 21, the vibratory compactor 22, and the wheel compactor 23. In other words, the work machine 1 may control the actuators of the work machine 1 so that the work tool 8 does not extend from the predetermined area to avoid interference between the work tool 8 and the cab 5 during operation of E-fence Function. Furthermore, during operation of the guidance functions, the work machine 1 may output posture information of the work tool 8 to the operator.

In order to implement the Machine Guidance Function and the E-Fence Function to the work machine 1, it may be needed to increase measuring points of the work tool 8 for measurement and to select a guidance point from various measuring points (e.g., wheel or blade of the compactors) for guidance to a target point, since the work tools 8 may have various shapes.

Also, the work machine 1 may indicate a guidance angle "VERTICAL" (hereinafter, it may be referred as a second type of output information) so that it is perpendicular to the object to be crushed in case of the hammer 21, in addition to indication of a guidance angle "HORIZONTAL" or "LEVEL" (hereinafter, it may be referred as a first type of output information) in case of the bucket, the vibratory compactor 22 and the wheel compactor 23.

Figure 3:
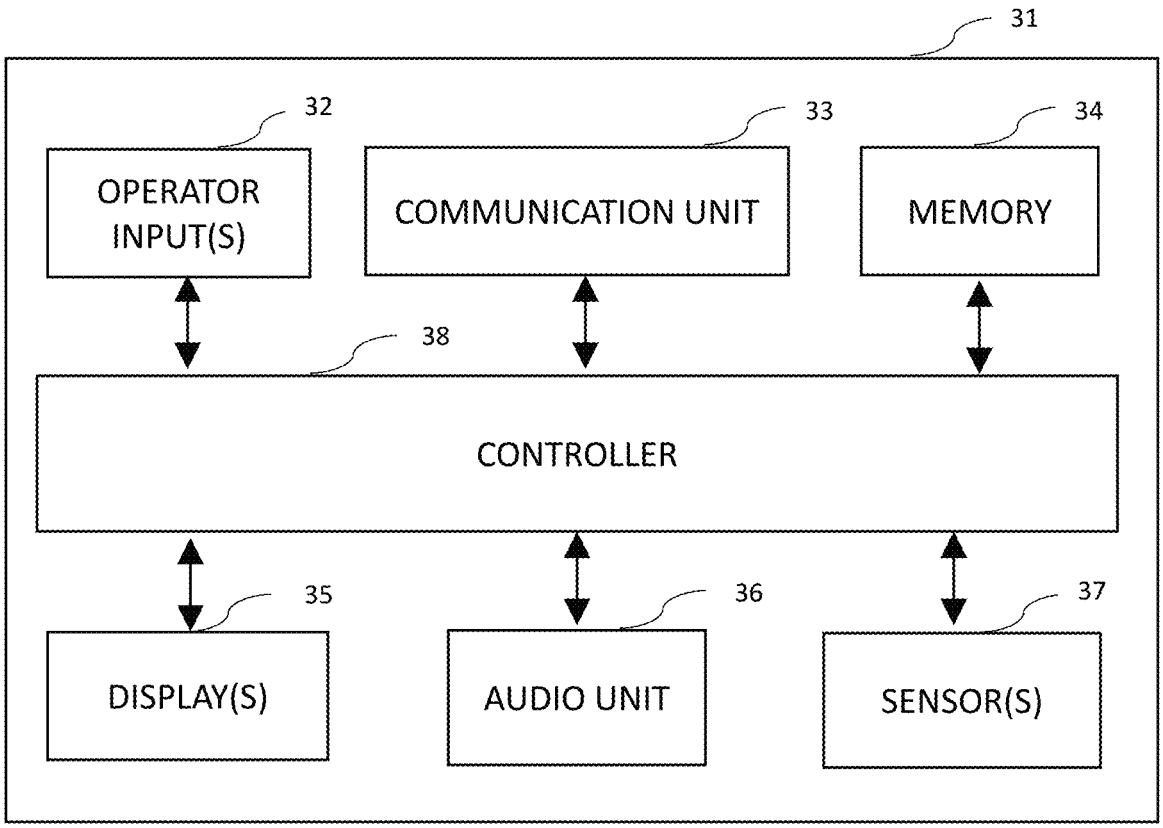
FIG. 3 shows a block diagram of a control system according to one or more embodiments of the disclosed subject matter.

Turning now to FIG. 3, FIG. 3 is a block diagram of a control system 31 of the work machine 1, according to one or more embodiments of the disclosed subject matter. As illustrated in FIG. 3, the control system 31 can include a controller 38, which may be implemented in or using control circuitry, one or more operator inputs 32, a communication unit 33, memory 34, one or more displays 35, an audio unit 36, and one or more sensors 37. The controller 38, as used herein, can include only one controller or multiple controllers.

The memory 34 may be operatively coupled to the controller 38 and may reside outside of the controller 38, such as shown in FIG. 3, and/or within the controller 38, i.e., as part of the controller 38. Generally, the memory 34 can receive and save therein data or information regarding operation of the work machine 1. As examples, the memory 34 can receive and save therein setting information of the Machine Guidance Function and the E-Fence Function, with regard to each type of the work tool 8 (e.g., bucket, hammer 21, vibratory compactor 22, and wheel compactor 23). As examples, the memory 34 can also receive and save therein measured data of the work machine 1, such as numerical data of the posture of the work tool 8.

The communication unit 33 may be (or may be part of) the control system 31. In this regard, the communication unit 33 can include transmit circuitry to transmit information or data, such as the setting information of the Machine Guidance Function and the E-Fence Function, with regard to each type of the work tool 8 (e.g., bucket, hammer 21, vibratory compactor 22, and wheel compactor 23) and measured data of the posture of the work tool 8, to a back office system. Optionally, the communication unit 33 can have receive circuitry to receive information or data from the back office system, for instance. In this embodiment, the communication unit 33 can be configured using a communication device such as a local CAN, a wired or wireless LAN, a communication card for Bluetooth, a router for communication, and a modem for communication.

The audio unit 36 may be comprised of one or more audio speakers, for instance, provided in the cab 5, to output audible information, such as alerts, to the operator of the work machine 1. As an example, the audio unit 36 can output an audible information which type of the work tool 8 is currently attached to the work machine 1 and which guidance function is currently activated to an operator of the work machine 1.

The one or more sensors 37 can detect various information of the work machine 1. For instance, the one or more sensors 37 can include a position sensor associated with rotation or swing of the work machine 1, a triaxial acceleration sensor (including an acceleration sensor, a gravity detection sensor, and a fall detection sensor) or a triaxial gyro sensor (including an angular velocity sensor, and a geomagnetic sensor). Outputs from the one or more sensors 37 may be fed back to the controller 38. Optionally, information from at least one of the one or more sensors 37 may be displayed on the display 35. As an example, the one or more sensors 37 can detect an angle of a target measurement point of the work tool 8 of the work machine 1.

The operator input(s) 32 can be (or can be part of) switches, a joystick lever, a foot pedal, a keyboard, and other input devices. Operator input to the display 35 can be implemented by a touch panel equipped with the display 35. In this regard, such at least one display 35 may be implemented on a display device operative to display a graphical user interface (GUI). Optionally, the one or more displays 35 may output an alert and a message to the operator of the work machine 1, for instance, information of the type of the work tool 8 that is currently attached to the work machine 1 and information of activated guidance function for the work tool 8.

The controller 38 can output control signaling to various system components (e.g., hydraulic systems, electrical systems, etc.) to control movement of the working machine 1 responsive to the operator input(s) 32. The controller 38 can include a CPU, a ROM, and a RAM.

In an exemplary implementation, the control system 31 of the work machine 1, or portions thereof, can be implemented using circuitry or processing circuitry that can include general purpose processors, special purpose processors, integrated circuits, ASICs ("Application Specific Integrated Circuits"), CPU (a Central Processing Unit), a micro processing unit (MPU), conventional circuitry and/or combinations thereof which are configured or programmed to perform the disclosed functionality. Processors can be considered processing circuitry or circuitry as they include transistors and other circuitry therein. The processor may be a programmed processor which executes a program stored in a memory. In the disclosure, the circuitry, units, or means can be hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units can be a combination of hardware and software, the software being used to configure the hardware and/or processor.

Figure 4:
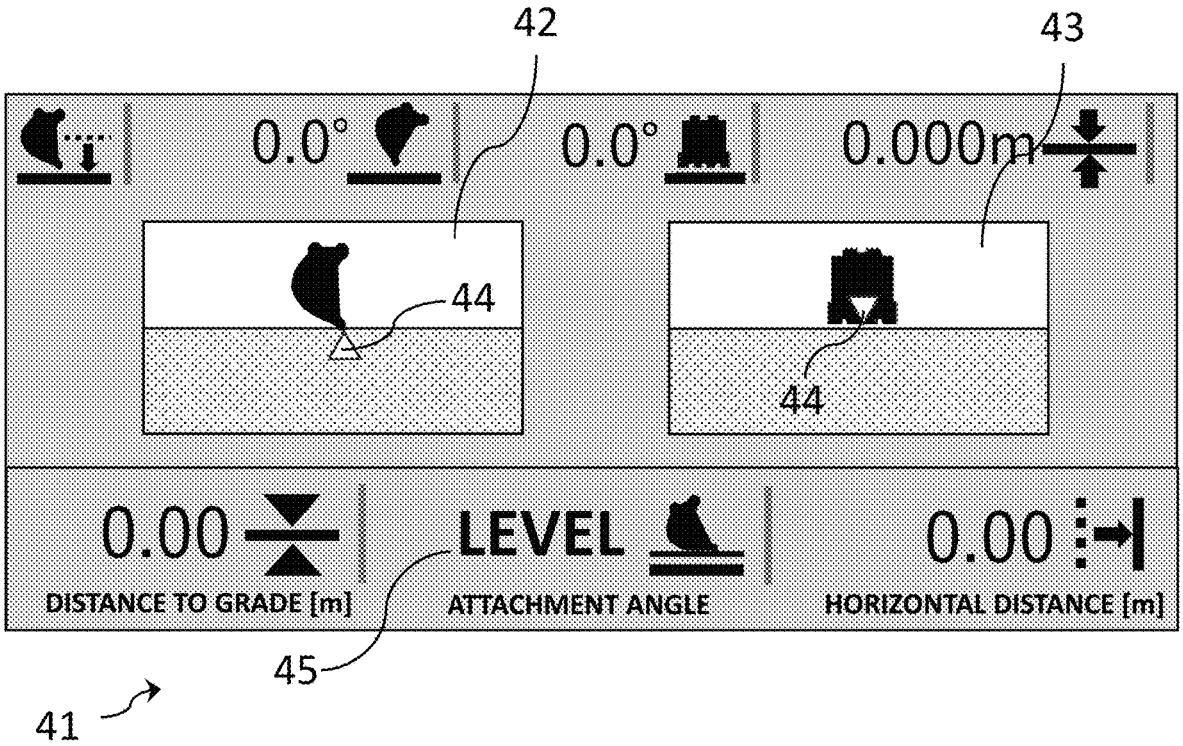
FIG. 4 shows an exemplary operator interface according to one or more embodiments of the disclosed subject matter.

Turning now to FIG. 4, FIG. 4 shows a schematic illustration of a guidance screen displayed on the display 35. In one or more embodiments, FIG. 4 may show a guidance screen 41 including a field 42 for indicating a side view of a work tool icon and a field 43 for indicating a front view of a work tool icon, in case that the bucket is attached to the work machine 1 as the work tool 8. A focus point 44 may be shown in both the field 42 and field 43 respectively, to indicate a target point for measurement of the posture of the work tool 8. The focus points 44 may be selected from one or more candidate points by the operator of the work machine 1 as discussed with FIG. 5 below. More specifically, the posture of the work tool 8 can defined from the position and angle of the work tool 8 in the XYZ coordinate system. In the one or more embodiments, the posture of the work tool 8 that is calculated based on the selected focus point, can be shown on the display 35 to provide visual information to the operator of the work machine 1 during operating the guidance functions (e.g., Machine Guidance Function, E-Fence Function, etc.)

The guidance screen 41 also may include a field 45 that can show a moving direction of the work tool 8. In this embodiment, the field 45 may show "LEVEL" since the bucket is attached to the work machine 1 as the work tool 8.

It is noted that embodiments of the disclosed subject matter are not limited to the specific arrangement of the fields on the guide screen 41 as shown in FIG. 4. For instance, embodiments of the disclosed subject matter can arrange the fields in different positions or include more fields on the guidance screen 41 for other functions of the work machine 1.

Figure 5:
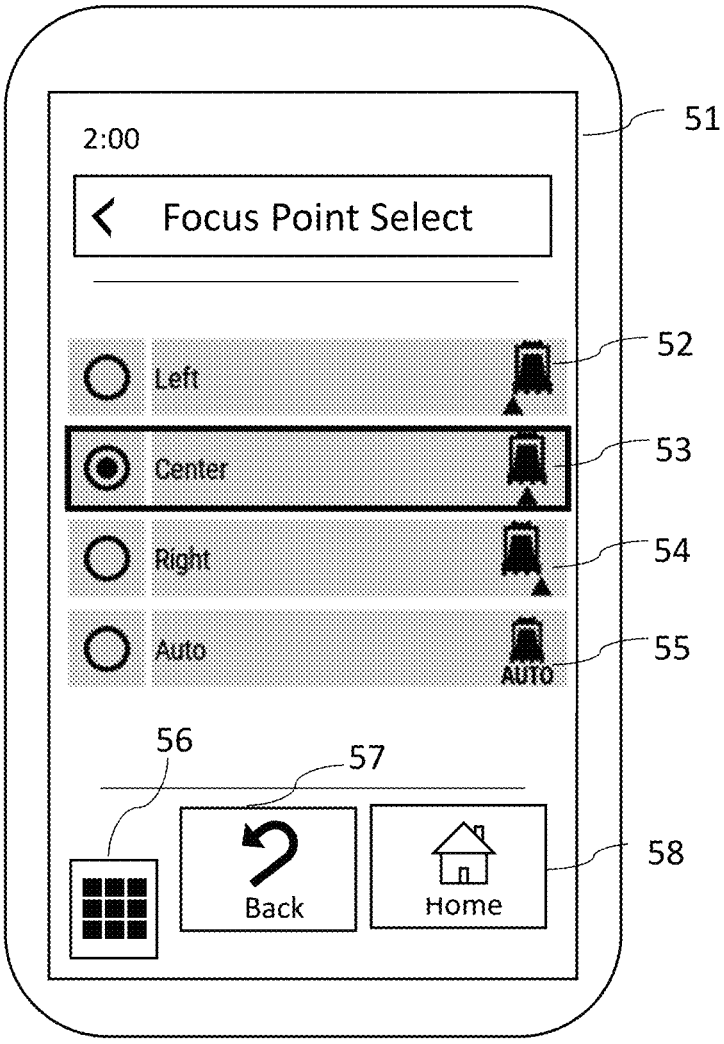
FIG. 5 shows an exemplary operator interface according to one or more embodiments of the disclosed subject matter.

FIG. 5 shows a schematic illustration of the display 35 when setting a focus point of the work tool 8 of the work machine 1. The display 35 can display a screen 51 for selecting and setting a focus point of the work tool 8 of the work machine 1 in case that the work tool 8 is the bucket. Fields 52, 53, 54 and 55 in the screen 51 can indicate the focus point of the work tool 8 as "Left", "Center", "Right" in front view and "Auto", respectively. Here, in FIG. 5, the field 53 may be currently selected based on an instruction input from the operator of the work machine 1 to set the focus point of the work tool 8 as "Center". When the field 55 is selected by the input from the operator of the work machine 1, the controller 38 of the work machine 1 may determine the focus point automatically based on information stored in the memory 34 (e.g., measured data by the sensor 37) at a predetermined period. Optionally or alternatively, the controller 38 of the work machine 1 may select a point that may be closest to a surface of the target material, among "Left", "Center" and "Right" in front view, in case that "Auto" is selected.

Optionally, the screen 51 can include fields 56-58 for a menu button, a back button, and a home button, respectively. The field 56 for the menu button can be to show a list of menu items, the field 57 for the back button can be to return to previous screen, and the field 58 for the home button can be to return to a home screen.

Optionally, as shown in FIG. 5, the display 35 can be equipped with the touch panel to input information to the controller 38, such as the setting information corresponding to the fields 52-55, and the commands corresponding to the menu button, the back button, and the home button can be input via the screen 51 by the touch panel of the display 35.

It is noted that embodiments of the disclosed subject matter are not limited to the specific arrangement of the fields and the buttons on the screen as shown in FIG. 5. For instance, embodiments of the disclosed subject matter can arrange the fields and the buttons in different positions or include more fields and buttons on the screen for other functions of the work machine 1.

Figure 6:
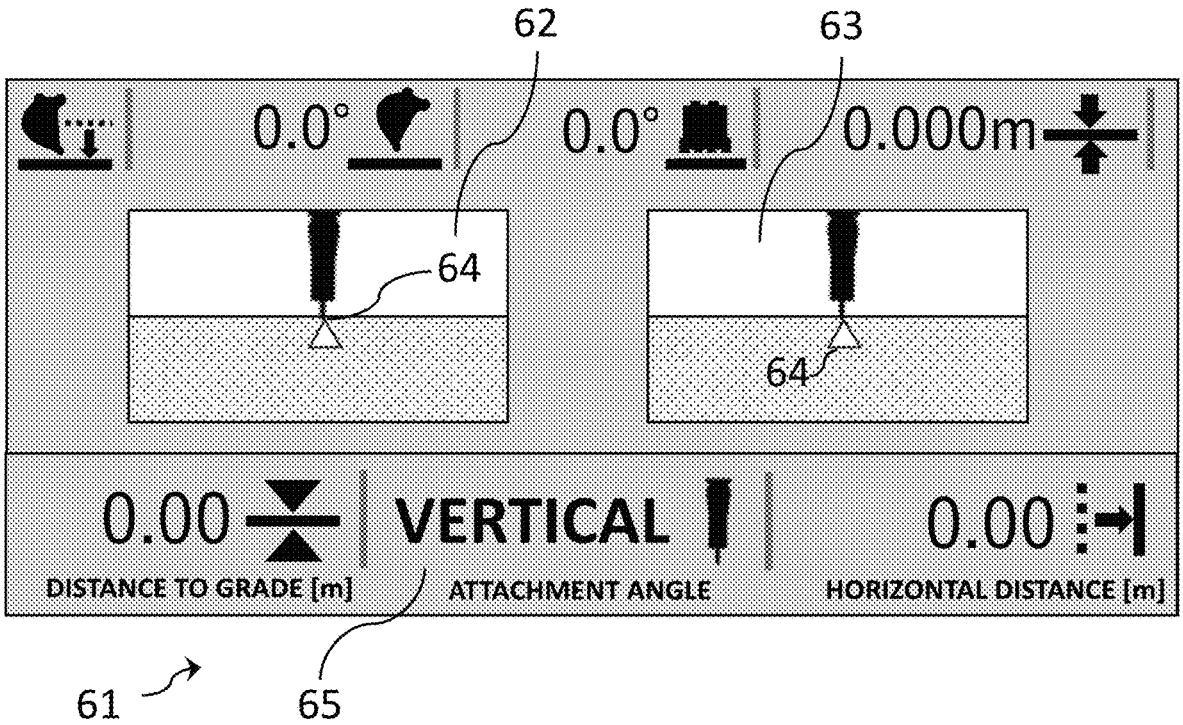
FIG. 6 shows an exemplary operator interface according to one or more embodiments of the disclosed subject matter.

Turning now to FIG. 6, FIG. 6 shows a schematic illustration of a guidance screen displayed on the display 35. In one or more embodiments, FIG. 6 may show a guidance screen 61 including a field 62 for indicating a side view of a work tool icon and a field 63 for indicating a front view of a work tool icon, in case that the hammer 21 is attached to the work machine 1 as the work tool 8. A focus point 64 may be shown in both the field 62 and field 63 respectively, to indicate a target point for measurement of the posture of the work tool 8. In this embodiment, the focus points 64 may be a contact point which the chisel 217 contacts surface of the target material.

The guidance screen 61 also may include a field 65 that can show a moving direction of the work tool 8. In this embodiment, the field 65 may show "VERTICAL" since the hammer 21 is attached to the work machine 1 as the work tool 8.

It is noted that embodiments of the disclosed subject matter are not limited to the specific arrangement of the fields on the guide screen 61 as shown in FIG. 6. For instance, embodiments of the disclosed subject matter can arrange the fields in different positions or include more fields on the guidance screen 61 for other functions of the work machine 1.

Figure 7:
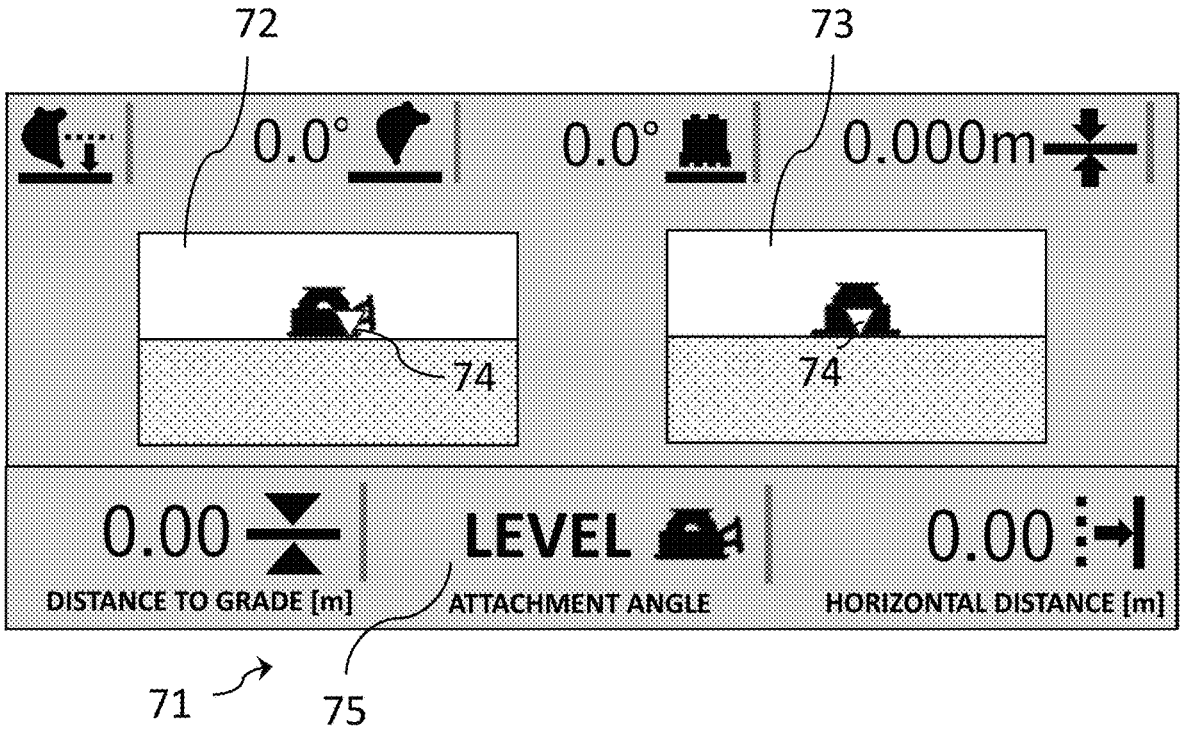
FIG. 7 shows an exemplary operator interface according to one or more embodiments of the disclosed subject matter.

Turning now to FIG. 7, FIG. 7 shows a schematic illustration of a guidance screen displayed on the display 35. In one or more embodiments, FIG. 7 may show a guidance screen 71 including a field 72 for indicating a side view of a work tool icon and a field 73 for indicating a front view of a work tool icon, in case that the vibratory compactor 22 is attached to the work machine 1 as the work tool 8. A focus point 74 may be shown in both the field 72 and field 73 respectively, to indicate a target point for measurement of the posture of the work tool 8. The focus points 74 may be selected from one or more candidate points by the operator of the work machine 1 as discussed with FIG. 8 below.

The guidance screen 71 also may include a field 75 that can show a moving direction of the work tool 8. In this embodiment, the field 75 may show "LEVEL" since the vibratory compactor 22 is attached to the work machine 1 as the work tool 8.

It is noted that embodiments of the disclosed subject matter are not limited to the specific arrangement of the fields on the guide screen 71 as shown in FIG. 7. For instance, embodiments of the disclosed subject matter can arrange the fields in different positions or include more fields on the guidance screen 71 for other functions of the work machine 1.

Figure 8:
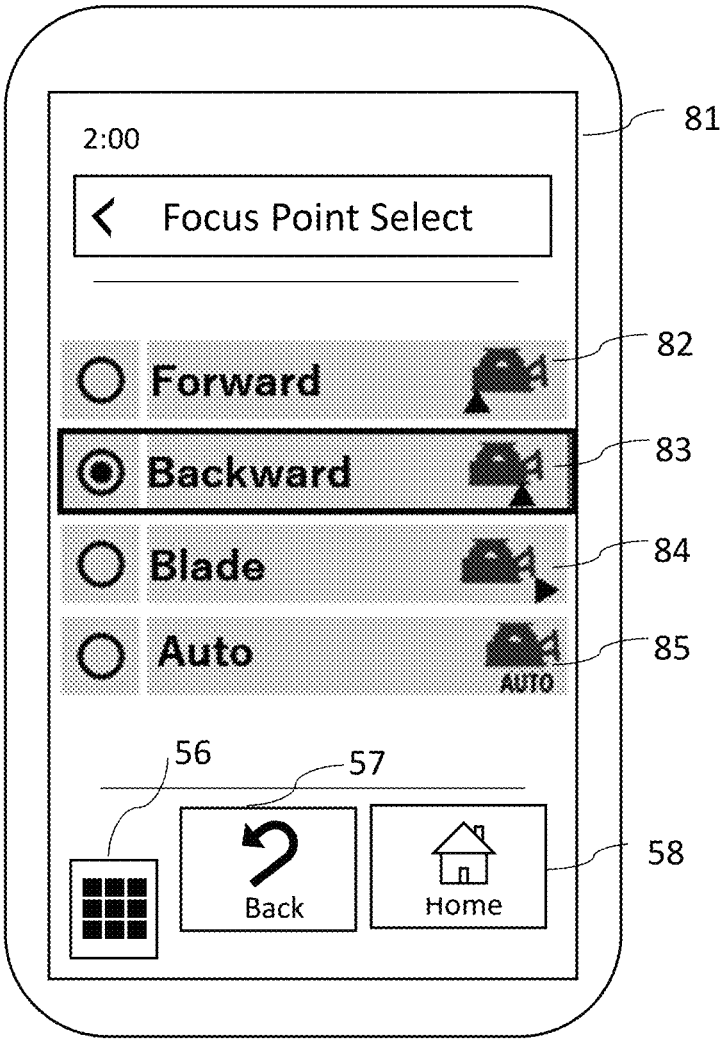
FIG. 8 shows an exemplary operator interface according to one or more embodiments of the disclosed subject matter.

FIG. 8 shows a schematic illustration of the display 35 when setting a focus point of the work tool 8 of the work machine 1. The display 35 can display a screen 81 for selecting and setting a focus point of the work tool 8 of the work machine 1 in case that the work tool 8 is the vibratory compactor 22. Fields 82, 83, 84 and 85 in the screen 81 can indicate the focus point of the work tool 8 as "Forward", "Backward", "Blade" in side view and "Auto", respectively. Here, in FIG. 8, the field 83 may be currently selected based on an instruction input from the operator of the work machine 1 to set the focus point of the work tool 8 as "Backward". When the field 85 is selected by the input from the operator of the work machine 1, the controller 38 of the work machine 1 may determine the focus point automatically based on information stored in the memory 34 (e.g., measured data by the sensor 37) at a predetermined period. Optionally or alternatively, the controller 38 of the work machine 1 may select a point that may be closest to a surface of the target material, among "Forward", "Backward" and "Blade" in side view, in case that "Auto" is selected.

Optionally, the screen 81 can include fields 56-58 for the menu button, the back button, and the home button, respectively, as discussed with FIG. 5.

Optionally, as shown in FIG. 8, the display 35 can be equipped with the touch panel to input information to the controller 38, such as the setting information corresponding to the fields 82-85, and the commands corresponding to the menu button, the back button, and the home button can be input via the screen 81 by the touch panel of the display 35.

It is noted that embodiments of the disclosed subject matter are not limited to the specific arrangement of the fields and the buttons on the screen as shown in FIG. 8. For instance, embodiments of the disclosed subject matter can arrange the fields and the buttons in different positions or include more fields and buttons on the screen for other functions of the work machine 1.

Figure 9:
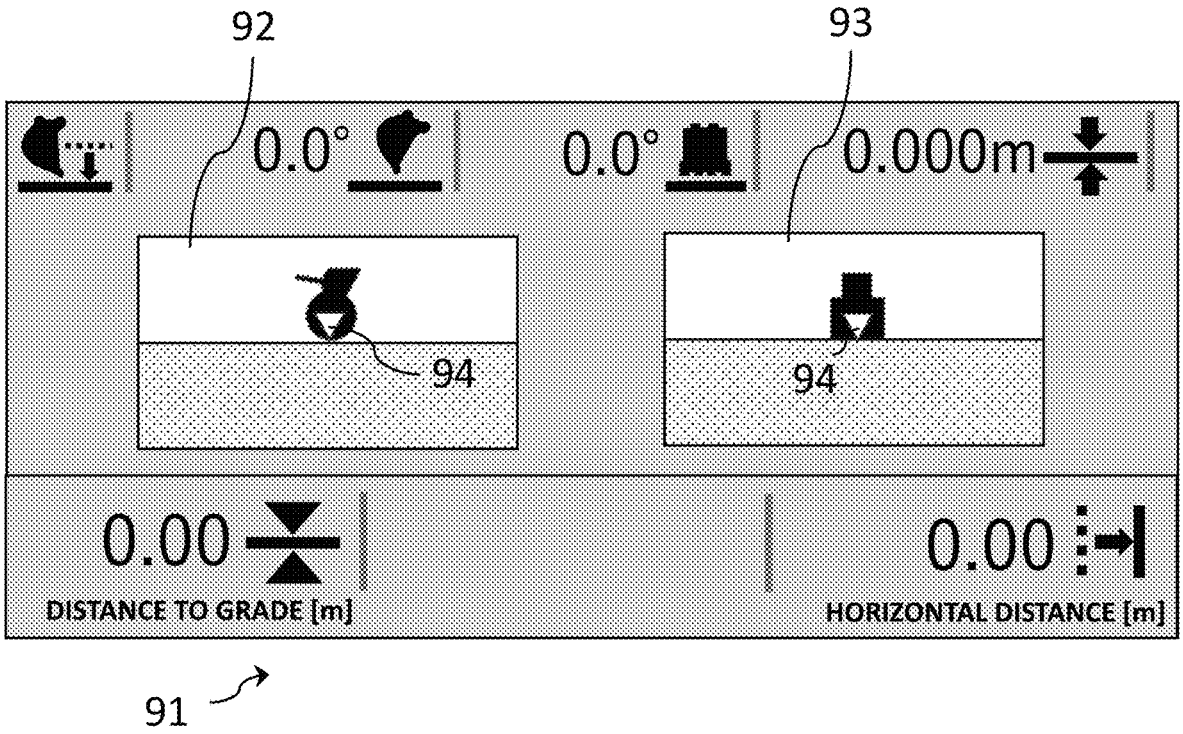
FIG. 9 shows an exemplary operator interface according to one or more embodiments of the disclosed subject matter.

Turning now to FIG. 9, FIG. 9 shows a schematic illustration of a guidance screen displayed on the display 35. In one or more embodiments, FIG. 9 may show a guidance screen 91 including a field 92 for indicating a side view of a work tool icon and a field 93 for indicating a front view of a work tool icon, in case that the wheel compactor 23 is attached to the work machine 1 as the work tool 8. A focus point 94 may be shown in both the field 92 and field 93 respectively, to indicate a target point for measurement of the posture of the work tool 8. The focus points 94 may be selected from one or more candidate points by the operator of the work machine 1 as discussed with FIG. 10 below. In this embodiment, the guidance screen 91 may not include a field for a moving direction of the work tool 8.

It is noted that embodiments of the disclosed subject matter are not limited to the specific arrangement of the fields on the guide screen 91 as shown in FIG. 9. For instance, embodiments of the disclosed subject matter can arrange the fields in different positions or include more fields on the guidance screen 91 for other functions of the work machine 1.

Figure 10:
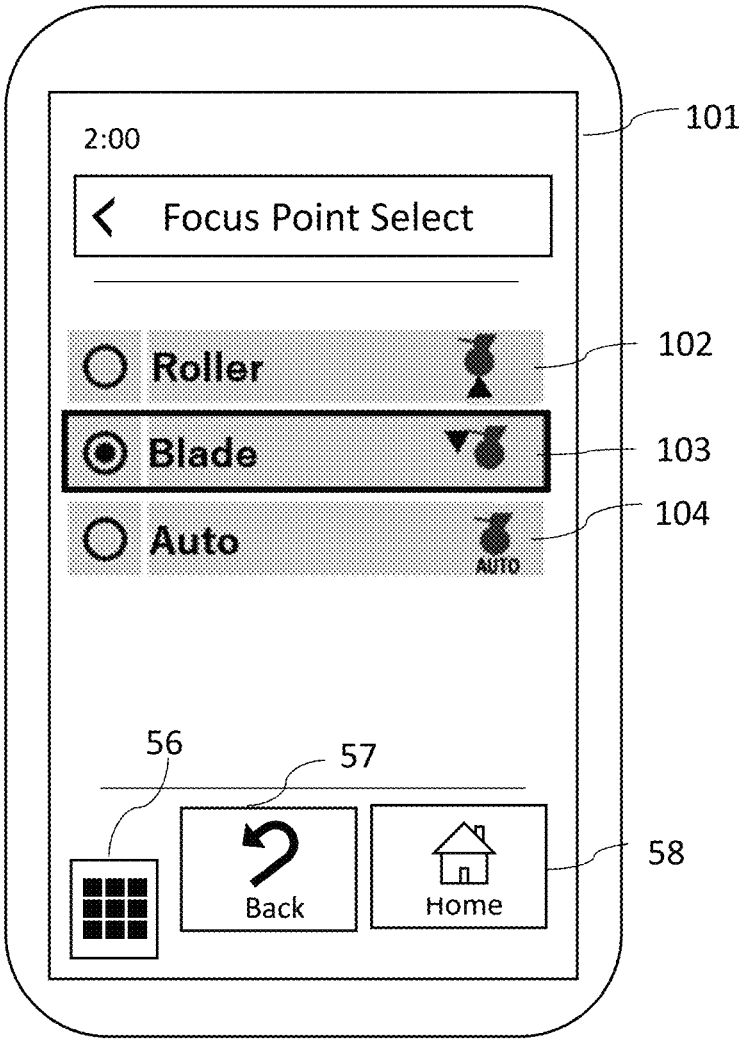
FIG. 10 shows an exemplary operator interface according to one or more embodiments of the disclosed subject matter.

FIG. 10 shows a schematic illustration of the display 35 when setting a focus point of the work tool 8 of the work machine 1. The display 35 can display a screen 101 for selecting and setting a focus point of the work tool 8 of the work machine 1 in case that the work tool 8 is the wheel compactor 23. Fields 102, 103 and 104 in the screen 101 can indicate the focus point of the work tool 8 as "Roller", "Blade" in side view and "Auto", respectively. Here, in FIG. 8, the field 103 may be currently selected based on an instruction input from the operator of the work machine 1 to set the focus point of the work tool 8 as "Blade". When the field 104 is selected by the input from the operator of the work machine 1, the controller 38 of the work machine 1 may determine the focus point automatically based on information stored in the memory 34 (e.g., measured data by the sensor 37) at a predetermined period. Optionally or alternatively, the controller 38 of the work machine 1 may select a point that may be closest to a surface of the target material, among "Roller" and "Blade" in side view, in case that "Auto" is selected.

Optionally, the screen 101 can include fields 56-58 for the menu button, the back button, and the home button, respectively, as discussed with FIG. 5.

Optionally, as shown in FIG. 10, the display 35 can be equipped with the touch panel to input information to the controller 38, such as the setting information corresponding to the fields 102-104, and the commands corresponding to the menu button, the back button, and the home button can be input via the screen 101 by the touch panel of the display 35.

It is noted that embodiments of the disclosed subject matter are not limited to the specific arrangement of the fields and the buttons on the screen as shown in FIG. 10. For instance, embodiments of the disclosed subject matter can arrange the fields and the buttons in different positions or include more fields and buttons on the screen for other functions of the work machine 1.

INDUSTRIAL APPLICABILITY

As noted above, the present disclosure relates to work machines, and more particularly to construction machines having various work tools, and systems, assemblies, and methods thereof.

Figure 11:
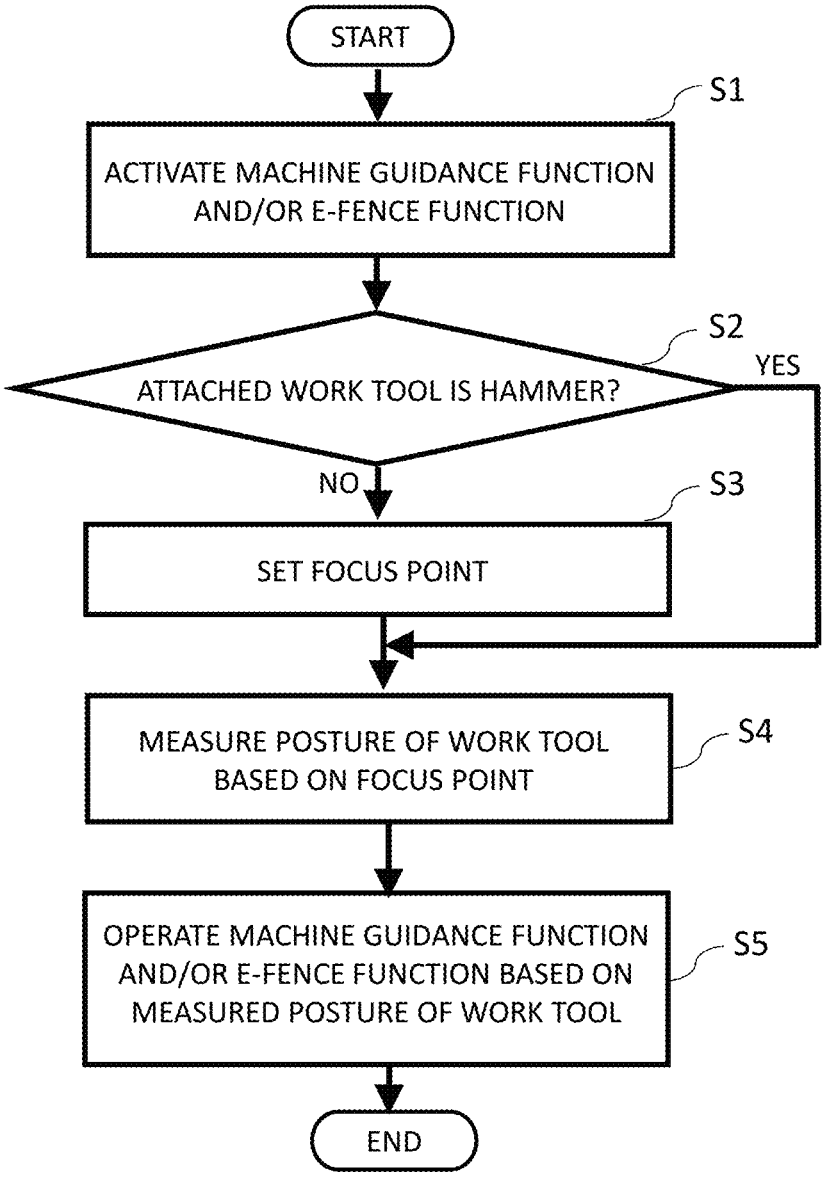
FIG. 11 is a flowchart of a method according to one or more embodiments of the disclosed subject matter.

FIG. 11 is a flowchart of a method of operating functions of a work machine according to one or more embodiments of the disclosed subject matter. Some or all of the operations of the methods can be performed by or using the controller 38. Further, some or all of each of the methods can be performed via a non-transitory computer-readable storage medium (or media) having stored thereon instructions that, when executed by one or more processors (e.g., of the controller 38) causes the one or more processors to perform some or all of the method(s).

The process of operating guidance functions, i.e., Machine Guidance Function and/or E-Fence Function, may be initiated when the controller 38 may activate the functions based on an input information from the operator of the work machine 1 via the operator input 32 (S1). The operator of the work machine 1 may input the information to activate Machine Guidance Function and/or E-Fence Function when an engine of the work machine 1 is started, when a new work tool 8 is attached by controlling a quick coupler of the work machine 1 during work, when the engine is restarted, etc. Optionally or alternatively, the controller 38 can automatically detect replacement of the work tool 8 and activate Machine Guidance Function and/or E-Fence Function for the new work tool 8.

Next, the controller 38 may perform a process of determination whether the work tool 8 that is currently attached to the work machine 1 is the hammer 21 or not (S2). Optionally or alternately, the controller 38 may display a screen to select and input the attached work tool 8 by the operator of the work machine 1. Optionally or alternately, the controller 38 may detect the attached work tool 8 based on sensing information by the sensor(s) 37 of the work machine 1.

Next, in the case where the determination of step S2 is NO, the controller 38 may perform a process of setting a focus point of the work tool 8 from one or more candidates (S3). More specifically, the controller 38 may display a screen to select and input the focus point of the work tool 8 by the operator of the work machine 1, as shown in FIGS. 5, 8 and 10. The operator of the work machine 1 may select the focus point based on types of work. For instance, if the attached work tool 8 is the wheel compactor 23 and next work of the work machine 1 is compacting the surface of soil by the blade 232 of the wheel compactor 23, the operator of the work machine 1 may select "Blade" as the focus point as shown in FIG. 10. The controller 38 may set the focus point of the work tool 8 based on the input from the operator of the work machine 1 via the operator input 32.

On the other hand, in the case where the determination of step S2 is YES, i.e., the attached work tool 8 is the hammer 21, the processing may skip step S3 and move to S4 of the processing shown in FIG. 11, since the focus point is preset for the hammer 21 as the contact point of the chisel 217.

Next, the controller 38 may perform a process of measuring the posture of the work tool 8 based on the selected focus point (S4). More specifically, the controller 38 may calculate a position of a target point of the work tool 8 which corresponds to the selected focus point in XYZ coordinate system. For instance, the controller 38 may calculate a distance of the target point of the work tool 8 which corresponds to the selected focus point from a reference point, and/or an angle of the target point of the work tool 8 which corresponds to the selected focus point from a reference plane in XYZ coordinate system.

Subsequent to step S4, the controller 38 may perform a process of operating Machine Guidance Function and/or E-Fence Function based on the measured posture of the work tool 8 (S5). More specifically, as Machine Guidance Function, if the attached work tool 8 is the bucket, the controller 38 may output the guidance screen 41 on the display 35 to assist the operator to operate the work machine 1 as shown in FIG. 4. Similarly, if the attached work tool 8 is the hammer 21, the controller 38 may output the guidance screen 61 on the display 35 to assist the operator to operate the work machine 1 as shown in FIG. 6. Similarly, if the attached work tool 8 is the vibratory compactor 22, the controller 38 may output the guidance screen 71 on the display 35 to assist the operator to operate the work machine 1 as shown in FIG. 7. Similarly, if the attached work tool 8 is the wheel compactor 23, the controller 38 may output the guidance screen 91 on the display 35 to assist the operator to operate the work machine 1 as shown in FIG. 9. In one or more embodiments, the guidance screens 41, 61, 71 and 91 can be displayed in three dimensional display.

For operating E-Fence Function, the controller 38 may calculate current coordinates and the coordinates after a predetermined time for one or more monitoring points based on the measured point of the work tool 8 corresponding to the focus point, during the operation of the work tool 8. When it is predicted that any of the monitoring points will reach a border of predetermined limited work area after the predetermined time, the controller 38 may calculate a degree of deceleration K according to the distance from the current coordinates of the monitor point to the border of predetermined limited work area, and control speed of actuator(s) of the work machine 1 to decelerate by multiplying the degree of deceleration K by the current actuator operating speed.

When one of the monitoring points is determined to reach prohibited area, the controller 38 may control the actuator(s) to stop by multiplying K=0 by the current actuator operating speed so that the work tool 8 does not extend from the limited work area. The controller 38 may output the position information of the work tool 8 as overlapping the limited work area on the display 35 during the operation of E-Fence Function. Optionally or alternatively, the position information of the work tool 8 and the limited work area can be displayed in three dimensional display.

Subsequent to step S5, the controller 38 may terminate the process.

It is noted that embodiments of the disclosed subject matter are not limited to the specific arrangement of the processing steps as shown in FIG. 11. For instance, embodiments of the disclosed subject matter can add more processing steps to control functions and indicate information on the display 35 of the work machine 1.

As a result of the embodiments, a work machine can apply guidance functions such as Machine Guidance Function and E-Fence Function to various types of the work tools such as hammers and compactors, and improve customer productivity and safety.

Thus, according to embodiments of the disclosed subject matter, a work machine can comprise a work tool attached to an end of a boom of the work machine; and processing circuitry. The processing circuitry can be configured to determine a type of the work tool, set a focus point of the work tool based on the type of the work tool, measure a posture of the work tool based on the focus point, and provide a guidance function to an operator of the work machine in accordance with the measured posture of the work tool based on the focus point.

The work machine can set an appropriate focus point based on a type of the work tool so that the work machine can provide appropriate guidance functions to the operator of the work machine.

In another aspect, a method for a work machine is disclosed or implemented. The method can comprise determining a type of a work tool of the work machine, outputting selectable information via an operator interface to select a focus point of the work tool from one or more candidates in accordance with the determined type of the work tool, setting the focus point of the work tool based on input via the operator interface, measuring a posture of the work tool based on the focus point, outputting guidance information based on the measured posture of the work tool and the focus point of the work tool, and providing a guidance function to the operator interface in accordance with the measured posture of the work tool based on the focus point.

And in another aspect a non-transitory computer-readable storage medium is disclosed or provided. The non-transitory computer-readable storage medium can comprise computer executable instructions, wherein the instructions, when executed by an information processing system of a work machine, cause the information processing system to perform a method, the method comprising, determining a type of a work tool of the work machine, setting a focus point of the work tool based on input via an operator interface, measuring a posture of the work tool based on the focus point, determining a type of output information based on the type of the work tool, the output information including direction information of the work tool, providing a guidance function with a first type of output information to the operator interface in accordance with the measured posture of the work tool based on the focus point, switching the type of output information from the first type of output information to a second type of output information under a condition that the work tool is replaced from a first type of the work tool to a second type of the work tool, and providing the guidance function with the second type of output information to the operator interface in accordance with the measured posture of the work tool based on the focus point While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A work machine comprising:

a work tool attached to an end of a boom of the work machine; and processing circuitry configured to determine a type of the work tool, set a focus point of the work tool based on the determined type of the work tool, the focus point being a target point for measurement of a posture of the work tool, measure the posture of the work tool based on the focus point, and provide a guidance function to an operator of the work machine, for operation of the work machine with the work tool, in accordance with the measured posture of the work tool based on the focus point, wherein the focus point as the target point is a contact point on the work tool.

2. The work machine according to claim 1, wherein the processing circuitry outputs selectable information on a display to select the focus point from one or more candidates.

3. The work machine according to claim 1, wherein the work tool is a compactor, wherein the compactor is a vibratory compactor with a blade, and wherein the selectable information to select the focus point includes a forward point of the compactor, a backward point of the compactor, and a point of the blade of the compactor, in a side view of the compactor.

4. The work machine according to claim 1, wherein the work tool is a compactor, wherein the compactor is a wheel compactor with a roller and a blade, and wherein the selectable information to select the focus point that includes a center point of the roller of the compactor and a point of the blade of the compactor, in a side view of the compactor.

5. The work machine according to claim 2, wherein the processing circuitry is configured to provide selectable information to select the focus point including an automatic mode, and select the focus point from one or more candidates based on predetermined information without input from the operator, in case that the automatic mode is selected.

6. The work machine according to claim 1, wherein the processing circuitry is configured to provide a first guidance function as the guidance function to the operator of the work machine for the operation of the work machine with the work tool, and output an icon of the work tool and the focus point in at least one of a side view and a front view of the work tool on a screen of a display during operation of the first guidance function for the operation of the work machine with the work tool.

7. The work machine according to claim 6, wherein the processing circuitry is configured to output a direction of the work tool on the screen of the display during the operation of the first guidance function for the operation of the work machine with the work tool.

8. The work machine according to claim 7, wherein the processing circuitry is configured to output the direction of the work tool as vertical direction.

9. The work machine according to claim 1, wherein the processing circuitry is configured to provide a second guidance function as the guidance function to the operator of the work machine for the operation of the work machine with the work tool, calculate current coordinates and further coordinates after a predetermined time for the measured posture of the work tool corresponding to the focus point of the work tool, and as part of the operation of the work machine with the work tool, control an operating speed of at least one actuator of the work machine so that the work tool does not extend from a predetermined work area during operation of the second guidance function.

10. The work machine according to claim 9, wherein the processing circuitry is configured to output position information of the work tool and the predetermined work area on a display of the work machine during the operation of the second guidance function for the operation of the work machine with the work tool.

11. A method for controlling a work machine comprising:

determining, using a processor, a type of a work tool of the work machine;

outputting, using the processor, selectable information via an operator interface to select a focus point of the work tool from one or more candidates in accordance with the determined type of the work tool;

setting, using the processor, the focus point of the work tool based on input via the operator interface, the focus point being a target point for measurement of a posture of the work tool;

measuring, using the processor, the posture of the work tool based on the focus point;

outputting. using the processor, guidance information based on the measured posture of the work tool and the focus point of the work tool; and providing a guidance function to the operator interface, for operation of the work machine with the work tool, in accordance with the measured posture of the work tool based on the focus point, wherein the focus point as the target point is a physical point on the work tool.

12. The method according to claim 11, wherein the guidance function is a machine guidance function and/or an e-fence function, and the method further comprises:

activating the guidance function responsive to starting or restarting of an engine of the work machine and/or upon a new work tool as said work tool being attached to the work machine.

13. The method according to claim 11, wherein the work tool is a vibratory compactor, the vibratory compactor having a blade, and wherein the selectable information for selecting the focus point includes a forward point of the compactor, a backward point of the compactor, and a point of the blade of the compactor, in a side view of the compactor.

14. The method according to claim 12, wherein the work tool is a wheel compactor, the wheel compactor having a roller and a blade, and wherein the selectable information for selecting the focus point includes a center point of the roller of the compactor and a point of the blade of the compactor, in the side view of the compactor.

15. The method according to claim 11, wherein the selectable information to select the focus point includes an automatic mode to select the focus point from one or more candidates based on predetermined information without input from the operator.

16. The method according to claim 11, further comprising:

providing a first guidance function as the guidance function via the operator interface to perform the operation of the work machine with the work tool; and outputting an icon of the work tool and the focus point in at least one of a side view and a front view of the work tool on a screen of a display during operation of the first guidance function to perform the operation of the work machine with the work tool.

17. The method according to claim 11, further comprising:

providing a second guidance function as the guidance function to an operator of the work machine to perform the operation of the work machine with the work tool, calculating current coordinates and further coordinates after a predetermined time for the measured posture of the work tool corresponding to the focus point of the work tool, and as part of the operation of the work machine with the work tool, controlling an operating speed of at least one actuator of the work machine so that the work tool does not extend from a predetermined work area during operation of the second guidance function to perform the operation of the work machine with the work tool.

18. A non-transitory computer-readable storage medium including computer executable instructions, wherein the instructions, when executed by an information processing system of a work machine, cause the information processing system to perform a method, the method comprising:

determining a type of a work tool of the work machine;

setting a focus point of the work tool based on input via an operator interface, the focus point being a target point for measurement of a posture of the work tool;

measuring the posture of the work tool based on the focus point;

determining a type of output information based on the type of the work tool, the output information including direction information of the work tool;

providing a guidance function with a first type of output information to the operator interface, for operation of the work machine with the work tool, in accordance with the measured posture of the work tool based on the focus point;

switching the type of output information from the first type of output information to a second type of output information under a condition that the work tool is replaced from a first type of the work tool to a second type of the work tool; and providing the guidance function with the second type of output information to the operator interface in accordance with the measured posture of the work tool based on the focus point, wherein the focus point as the target point is a point on the work tool.

19. The non-transitory computer-readable storage medium according to claim 18, wherein the first type of the work tool is any one of a bucket, a vibratory compactor, and a wheel compactor, and the first type of output information indicates horizontal direction as the direction information of the work tool.

20. The non-transitory computer-readable storage medium according to claim 19, wherein the second type of the work tool is a hammer, and the second type of output information indicates vertical direction as the direction information of the work tool.

* * * * *